United States Patent [19]

Aubert

[11] Patent Number: 4,745,387

[45] Date of Patent: May 17, 1988

[54] COIL CONNECTION FOR AN IRONLESS SOLENOIDAL MAGNET

[75] Inventor: Guy Aubert, Grenoble, France

[73] Assignee: Centre National de la Recherche Scientifique, Paris, France

[21] Appl. No.: 13,980

[22] PCT Filed: Apr. 22, 1986

[86] PCT No.: PCT/FR86/00137

§ 371 Date: Jan. 6, 1987

§ 102(e) Date: Jan. 6, 1987

[87] PCT Pub. No.: WO86/06870

PCT Pub. Date: Nov. 20, 1986

[30] Foreign Application Priority Data

May 10, 1985 [FR] France ..... 85 07152

[51] Int. Cl.[4] ..... H01F 5/00

[52] U.S. Cl. ..... 335/299; 335/300

[58] Field of Search ..... 335/299, 300; 324/318, 324/319, 320, 321

[56] References Cited

U.S. PATENT DOCUMENTS 4,591,818 5/1986 Butson ..... 324/320 X 4,623,864 11/1986 Inoue et al. ..... 335/299

FOREIGN PATENT DOCUMENTS 1494887 9/1967 France ..... 335/299

1600511 9/1970 France ..... 335/299

*Primary Examiner*—George Harris

*Attorney, Agent, or Firm*—Oblon, Fisher, Spivak, McClelland & Maier

[57] ABSTRACT

A structure is provided for connecting the disks of a Bitter coil. The disks each include a cut out in the form of a slit, for example undulating so as to define from one disk to another zones with overlapping of turns divided into two groups and the electric connections are provided by junctions of said overlapping zones of one group or the other, alternatively from one disk to another.

7 Claims, 2 Drawing Sheets

FIG_3
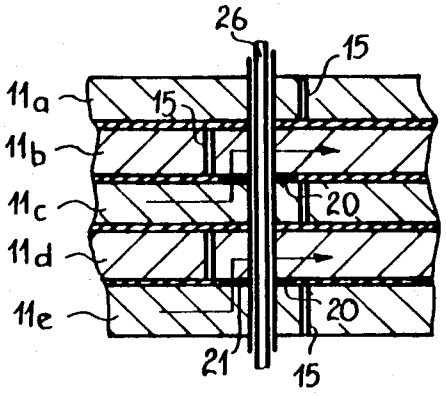
FIG_2
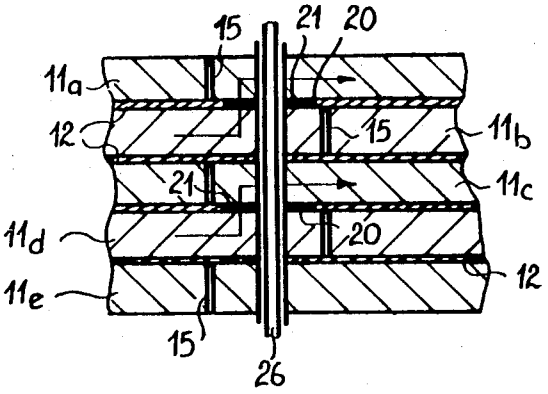
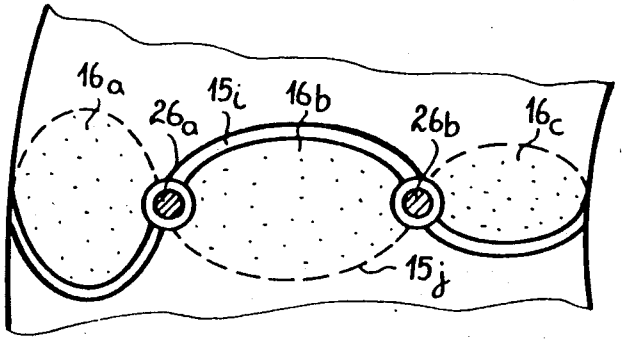
FIG_4

COIL CONNECTION FOR AN IRONLESS SOLENOIDAL MAGNET

BACKGROUND OF THE INVENTION

1. Field of the Invention

The invention, due to the collaboration of the Service National des Champs Intenses of the CNRS (Director M. AUBERT), relates to an ironless solenoidal magnet having one or more coils whose technological structure is closely related to that of a conventional Bitter coil, the invention relates more particularly to improvements for simplifying the manufacture of the coil or coils and improving the homogeneity of the magnetic field generated by such a type of magnet.

Bitter coils are well known for producing intense magnetic fields. In theory, the structure proposed by Bitter is a coil formed of annular metal disks split so as to form as many turns and connected together so as to define a substantially helical winding with flat turns. The stack of disks is held in position by a plurality of tie rods. This structure is advantageous for it allows efficient cooling of the magnet by forming holes in the disks (and in the insulators separating these disks), these holes being disposed in the same configuration from one disk to another so as to materialize an assembly of channels parallel to the axis of the coil, in which flows a cooling fluid, for example deionized water, kerosene or oil.

The invention provides a magnet formed of at least one coil derived from this concept and more particularly designed so that the magnetic field generated in a sphere of interest of prescribed radius, whose center merges with the center of symmetry of this magnet, has a very good homogeneity. A privileged field of application of the invention is in fact that of NMR (nuclear magnetic resonance) image formation where it is necessary to have a relatively high magnetic field (0.15 to 1.5 teslas) with a very high homogeneity, of the order of 1 to 10 parts per million (ppm). With a sufficiently long coil, a certain homogeneity can be obtained about the center of symmetry of this coil. Such homogeneity will be more easily attained and with a more compact structure either by varying the thickness of the disks along the axis of the magnet or by aligning several Bitter coils along a common axis, the lengths of the coils and the spacing therebetween being chosen so as to provide the required homogeneity. These solutions are described in other patent applications filed by the applicant. The improvements of the invention apply not only to a magnet having a single coil but also to a magnet having several aligned coils, disposed side by side or spaced apart.

There may in fact exist other structural causes of inhomogeneity of the magnetic field generated or causes of disturbance of this magnetic field.

2. Description of the Prior Art

Thus, in one widely used embodiment of the Bitter coil, the connection of two adjacent turns is simply obtained by forming each insulating disk, inserted between the two conducting rings, so that it has a cut out in the form of a sector and by clamping the stack of conducting disks and insulating disks between two end plates, by means of the above mentioned tie rods. The electric contact between two adjacent turns is thus established through the corresponding cut out under the effect of the clamping, the construction of the magnet being greatly facilitated thereby. However, the fact of facing up to the problem of obtaining a very uniform field from coils of this kind leads to recognizing in such an arrangement another cause of disturbance of the magnetic field. In fact, the variation of current density in each turn in the contact sector is an intrinsic cause of inhomogeneity.

SUMMARY OF THE INVENTION

The invention provides firstly a new type of assembly of disks for overcoming this problem.

To this end, the invention relates then essentially to a solenoidal magnet of the type having at least one coil formed of a stack of annular conducting disks with interpositioning of insulators, each disk having a cut out transforming it into a turn and said turns being connected end to end, wherein said disks extend in respective parallel planes perpendicular to the longitudinal axis of said coil, said cut out in each disk is a slit, The arrangement and form of these slits defines several zones of overlapping of turns between the successive disks, these zones being divided into two groups, and the electric contact between any two adjacent disks is provided by the junction thereof with a group of said overlapping zones whereas the electric contacts from disk to disk are provided by junctions on one or other group of said overlapping disks, alternately.

In one possible embodiment, said slits are scalloped slits (undulating or in the form of saw teeth or similar) and they are reversed from one disk to another with respect to a plane passing through the axis of the coil, so as to define said overlapping zones.

The above defined structure affects little the configuration of the current density at the junctions between adjacent turns. In particular, the increase in conductor thickness at the level of the junctions between turns is compensated for by the reduction of the area of these same junctions. It may then be considered that the current density does not vary over a complete turn. Furthermore, the radial current distribution naturally undergoes a disturbance at the level of each junction between two adjacent turns, but these disturbances counterbalance each other from one turn to another. All these features mean that a coil thus constructed has few intrinsic causes of inhomogeneity of the axial magnetic field generated. Furthermore, the axial component of the current, due in prior systems to the helical shape of the turns, does not exist because each turn extends in a plane. There is created on the contrary a longitudinal very "localized" current component, parallel to a generatrix of the coil in the vicinity of the junction zones between disks. This disturbance may be readily offset locally by means of longitudinal conductors through which currents flow in opposite directions. With this in mind, the invention solves another problem, namely the need to take into consideration the way in which the current is applied to the magnet. In fact, although the connection between the power supply source and the magnet is conventionally formed by means of two conductors connected respectively to the axial ends of the magnet, magnetic field disturbances generated by these conductors may impair the homogeneity of the field in the sphere of interest mentioned above. If the current is brought back by means of longitudinal conductors judiciously placed in the vicinity of the junctions between disks, the desired compensation is provided on the one hand and on the other the current is brought back to the axial end of the magnet at which it was injected, without creating a loop likely to disturb the homogeneity of the magnetic field delivered. This means that the current source can be connected to the same axial end of the magnet, by means of conductors with coaxial structure.

Thus, the invention also relates to a solenoidal magnet complying with the above definition, wherein the or each coil has at least one conduit parallel to said axis, defined by the superimposition of holes formed in or in the vicinity of longitudinally superimposed overlapping zones, each conduit housing a current return conductor connected between the last turn of an axial end of the magnet and emerging at its other axial end for connection to a terminal of a DC supply source. If the magnet includes several spaced coils, the current return conductors may pass through the spaces between coils inside respective metal tubes, themselves connected so as to connect said coils together in series. This type of coaxial connection structure creates no field in the spaces.

BRIEF DESCRIPTION OF THE DRAWINGS

The invention will be better understood and other advantages thereof will appear more clearly from the following description of several embodiments putting its principle into practice, given solely by way of example with reference to the accompanying drawings in which:

FIG. 2 is a partial section through II—II of FIG. 1;

FIG. 3 is a partial section through III—III of FIG. 1;

FIG. 4 is a view similar to FIG. 1, illustrating a variant; and

DESCRIPTION OF THE PREFERRED EMBODIMENTS

Figure 1:
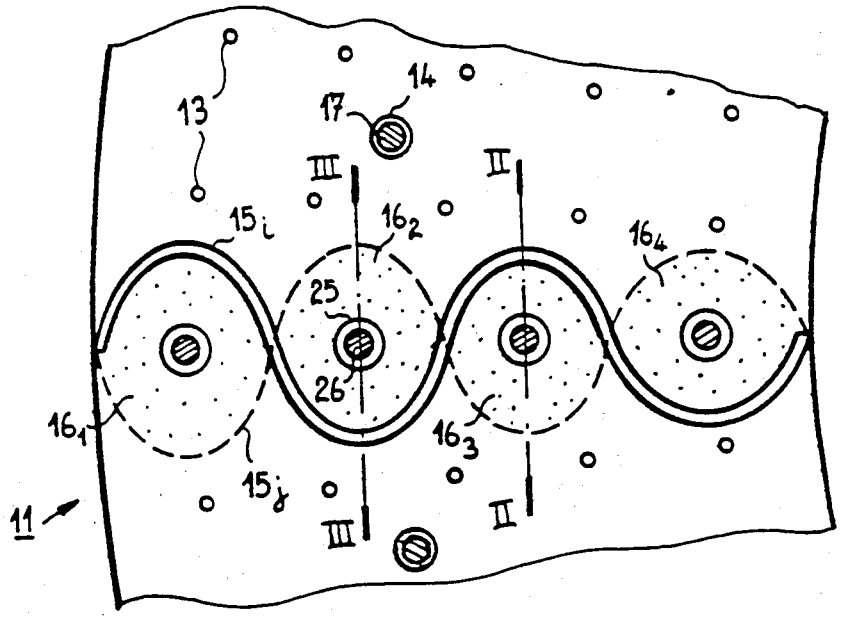
FIG. 1 is a partial view showing a disk of a coil forming the magnet, the disk being provided with a scalloped slit in accordance with the preceding definition.

Referring to the drawings, there are partially shown annular disks 11 forming a coil entering into the construction of the magnet. These are annular metal disks (typically made from copper or aluminum) stacked with interpositioning of insulating sheets 12 of the same shape and connected end to end so as to form said coils. The sections of FIGS. 2 and 3 show five annular disks 11*a*, 11*b*, 11*c*, 11*d*, 11*e* mounted in this way. As mentioned above, several coils of this kind are used, aligned axially, disposed side by side or spaced from each other, so as to form a magnet delivering a magnetic field with high homogeneity in a given internal volume. In the example described, the disks have a structure in accordance with that proposed by Bitter, that is to say that they include more particularly holes 13 disposed in the same configuration from one disk to another so as to be superimposed and define channels through which flows a cooling fluid. If required, the disks also include holes 14 of a larger diameter, superimposed in a similar way so as to allow the passage of insulated tie rods 17. The main purpose of the tie rods (which may also be external to the disks) is to hold the disks 11 and the insulating sheets 12 together in a clamped stack. According to the invention, the disks are not deformed so as to become more or less helical portions, but they extend on the contrary parallel to each other, in their respective planes, perpendicularly to the longitudinal axis of the coil and each disk has a slit 15 which (in the examples described) is a scalloped slit, extending from its external edge to its internal edge. Furthermore, all the scalloped slits are all grouped together in the same longitudinal portion of the coil but reversed from one disk to another. Thus, in FIGS. 1 and 4 there has been shown one of the slits $\mathbf{15}_i$ with a continuous line whereas the slit $\mathbf{15}_j$ of the adjacent disk is shown in outline by a broken line. It can be seen that, because of the nature of the slits on the one hand and the reversal from one disk to another on the other, zones of overlapping of turns 16 are defined between two juxtaposed slits, the number of overlapping zones depending here on the number of undulations of the scalloped slit. Thus, in the example shown in FIG. 1, four overlapping zones are defined between any two adjacent disks whereas in the example shown in FIG. 4 there are only three. It is clear that the overlapping zones between turns form as many possible contact zones for connecting the turns end to end for defining the coil. According to another important characteristic of the invention the electric contact between any two adjacent disks is provided by their junctions on a group (a part) of said overlapping zones whereas the electric contacts from disk to disk are provided by junctions on one or other group of said overlapping zones, alternately.

Thus, in the example shown in FIGS. 1 to 3, where the overlapping zones are even in number (four), said zones are used alternately (radially) for providing said electric contacts. In other words, said overlapping zones at the level of each disk are divided into two groups, zones $\mathbf{16}_1$, $\mathbf{16}_3$ on the one hand and $\mathbf{16}_2$, $\mathbf{16}_4$ on the other, which will always be used together for providing the electric contacts between two adjacent disks. In the particular example shown in FIG. 4 where the overlapping zones are three in number $\mathbf{16}_a$, $\mathbf{16}_b$, $\mathbf{16}_c$ for each disk (zone $\mathbf{16}_b$ being situated between zone $\mathbf{16}_a$ and $\mathbf{16}_c$), the electric contacts between disks will be provided alternately by their junction with a zone $\mathbf{16}_b$ then by their junction with two zones $\mathbf{16}_a$, $\mathbf{16}_c$ and so on.

As shown in FIGS. 2 and 3 relating to the embodiment of FIG. 1, the junctions are formed through windows 20 provided in the insulating sheets 12. The windows are provided opposite the selected overlapping zones so as to establish the contact between two disks considered. Advantageously, the reliability of the contact is improved by welding 21 with a make-up metal, said weld having substantially the same thickness as the insulating sheet. An indium welding material will be preferably used. If the thickness of the insulating sheet is sufficiently small, the make-up indium may be provided beforehand by electrolytic deposition on the selected overlapping zones, welding then consisting in locally heating the turns during assembly.

The areas of the different overlapping zones of the same disk are not equal, they depend both on their even or uneven number (thus in the example shown in FIG. 4, zone, $\mathbf{16}_b$ is necessarily larger) and on the value of the current density in the vicinity of said zones. This feature is especially important when the current return system which will be described below is used for counterbalancing the local field disturbances due to the existance of longitudinal current components (see the arrows in FIGS. 2 and 3 symbolizing the path of the current) in the passages between adjacent disks. In fact, in another aspect of the invention, holes 25 are formed in the overlapping zones (FIG. 1) or in the neighborhood thereof (FIG. 4), these holes being superimposed so as to define one or more parallel conduits each housing a current return conductor 26, connected between the last turn of an axial end of the magnet and emerging at the other axial end to which the DC power supply source is connected. Each conductor 26 is of course insulated inside the conduit which contains it. The fact of bringing the current back to this axial end of the magnet facilitates the connection to the two poles of the power supply source, this connection being able to be provided from structures with coaxial structure not creating any magnetic field disturbance. Furthermore, as mentioned above, the current return conductors in the same magnet may, if they are judiciously disposed, compensate for the local disturbances created at the junctions between disks. The compensation is provided by taking into account the following parameters: the number of overlapping zones in each disk, their respective areas, the number of current return conductors and their positions with respect to the overlapping zones. The general principle to be respected for determining the different parameters is that each current return conductor must have flowing therethrough a current substantially equal to the current which flows through the overlapping zone or zones (or the fractions of zones) which it influences. Now, for reasons of simplicity, all the current return conductors are connected in parallel to the axial end of the magnet opposite the one to which the power supply source is connected; they have therefore flowing therethrough substantially equal fractions of the total current flowing through the magnet. The homologous overlapping zones (or the fractions of such zones) "compensated for" by the current return conductors must then have equal currents flowing therethrough. Now, it will be recalled that in an annular disk coil, the current density in the width of the annular part is not uniform radially, but varies as 1/R, R being the distance from a point considered to the longitudinal axis of the coil. To take this fact into account, the areas of the overlapping zones may be accordingly varied. The example of FIG. 1 shows how the different parameters have been chosen in the case of an even number of overlapping zones (4 in this case). Because the overlapping zones are even in number, the electric contacts are provided by half of the zones on passing from one disk to another. It is then sufficient to choose the area of these zones by taking essentially into consideration the variation of the current density as 1/R in the annular disk so that the currents which flow through these contact zones are substantially equal. This is why, in FIG. 1, the areas of zones $\mathbf{16}_1$, $\mathbf{16}_2$, $\mathbf{16}_3$, $\mathbf{16}_4$ decrease from the outside towards the inside of the annular disk. As long as the areas are correctly chosen, the current is divided equally in each pair of junctions, from disk to disk and compensation may be obtained from as many conductors 26 as there are overlapping zones (four in the example), each conductor passing substantially through the center of all the longitudinally superimposed overlapping zones. In the example shown in FIG. 4, corresponding to an uneven number of overlapping zones, it is necessary to take into account both the current density 1/R and the number of overlapping zones brought into play alternately so as to ensure the passage from one disk to another, since the groups of said overlapping zones necessarily comprise different numbers of such zones. Thus, in the specific case shown in FIG. 4, if the current density were radially constant, the zone $\mathbf{16}_b$ would have an area double that of each of the zones $\mathbf{16}_a$ or $\mathbf{16}_c$. To take into account the current density 1/R, the area of zone $\mathbf{16}_b$ is greater than that of each of the zones $\mathbf{16}_a$ or $\mathbf{16}_c$, but it represents less than twice the area of zone $\mathbf{16}_a$ and more than twice the area of zone $\mathbf{16}_c$. In this case, two current return conductors $\mathbf{26}_a$, $\mathbf{26}_b$ may be provided, having flowing therethrough respectively half the return current and being disposed between the overlapping zones. Conductor $\mathbf{26}_a$ thus provides current compensation for the whole of the superimposed zones $\mathbf{16}_b$ and a part of the superimposed zones $\mathbf{16}_b$ whereas conductor $\mathbf{26}_b$ ensures the current compensation for the whole of the superimposed zone $\mathbf{16}_c$ and the other part of the superimposed zone $\mathbf{16}_b$. Determination of the areas of the overlapping zones, i.e. the shape of the scalloped slits which define them, is within the scope of a man skilled in the art applying the above stated principles, in the light of the examples described.

Figure 5:
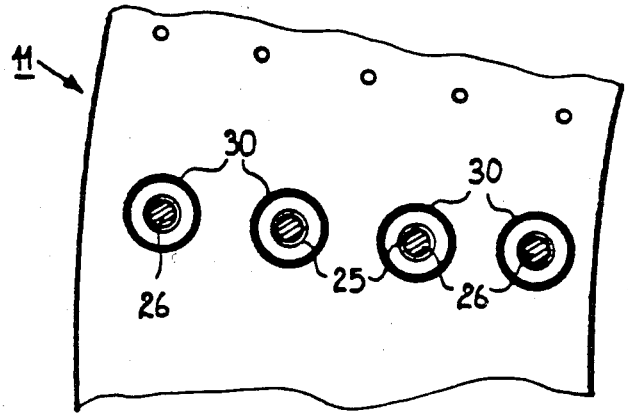
FIG. 5 is a partial view illustrating the end of a coil and connection thereof to an adjacent coil.

FIG. 5 illustrates the connection structure between coils of the magnet when this latter is formed of a number of coils spaced apart axially from each other. The four conductors 26 emerge from the last turn of the coil and each of them passes through the space between the two coils inside a metal tube 30 welded at each of its ends to the end most turn of the corresponding coil. The assembly of these tubes thus provides series connection of the coils. Substantially equal currents thus flow in opposite directions through tubes 30 and the current return conductors 25 and these connection structures do not create any magnetic field in the spaces between the coils.

What is claimed is:

1. A solenoidal magnetic of the type including:

at least one coil formed of a stack, with interpositioning of insulators, of annular conducting disks;

each disk having a cut out transforming it into a turn and said turns being connected end to end; wherein said disks extend in respective parallel planes perpendicular to the longitudinal axis of said coil;

said cut out of each said disk is a slit;

the arrangement and the form of the slits define several zones of overlapping of turns between and two juxtaposed slits;

said zones are divided into two groups; and the electric contact between any two adjacent disks is formed by a juction at a group of said overlapping zones, the electric contacts from disk to disk being provided by juctions at one of said groups of said overlapping zones and then at the other of said groups, in an alternating manner.

2. The solenoidal magnet according to claim 1, wherein said junctions are formed through windows provided in insulators inserted between said disks, said windows being disposed corresponding to overlapping zones selected for forming an electric contact.

3. The solenoidal magnet according to claim 1 or 2, wherein said juctions at a group of overlapping zones are welded junctions.

4. The solenodial magnet according to claim 3, including junctions welded with make-up indium.

5. The solenoidal magnet according to claim 1, wherein each coil includes at least one conduit, parallel to said axis, and defined by the superimpositioning of holes formed in longitudinal superimposed overlapping zones; and each conduit houses a current return conductor connected between the last turn of one axial end of the magnet and emerging at another axial end of the magnet for connection to a terminal of a DC power supply source.

6. The solenoidal magnet according to claim 1, wherein, said at least one coil is a Bitter coil having more particularly:

cooling fluid flow channels extending longitudinally and tie rods for clamping the stack of said disks.

7. The solenoidal magnet according to claim 1, wherein each coil includes at least one conduit, parallel to said axis, and defined by the superimpositioning of holes formed in the vicinity of longitudinal superimposed overlapping zones; and each conduit houses a current return conductor connected between the last turn of one axial end of the magnet and emerging at another axial end of the magnet for connection to a terminal of a DC power supply source.

* * * * *